United States Patent [19]

Detert et al.

[11] 3,983,884

[45] Oct. 5, 1976

[54] METHOD FOR MANUFACTURING TOBACCO FOIL

[75] Inventors: Ernst-Rolf Detert; Wilhelm Büchholz, both of Lubbecke, Germany

[73] Assignee: Eduard Gerlach GmbH, Lubbecke, Germany

[22] Filed: Apr. 24, 1975

[21] Appl. No.: 571,297

[30] Foreign Application Priority Data

May 4, 1974 Germany ..... 2421652

[52] U.S. Cl. ..... 131/140 C; 131/17 AC

[51] Int. Cl.[2] ..... A24B 3/14

[58] Field of Search ..... 131/17 AC, 140 C, 17

[56] References Cited

UNITED STATES PATENTS

| | | | |
|---|---|---|---|
| 2,845,933 | 8/1958 | Samfield et al. | 131/140 C |
| 3,865,120 | 2/1975 | Detert et al. | 131/140 C |

FOREIGN PATENTS OR APPLICATIONS

| | | | |
|---|---|---|---|
| 815,315 | 6/1959 | United Kingdom | 131/17 AC |

*Primary Examiner*—Robert W. Michell
*Assistant Examiner*—V. Millin
*Attorney, Agent, or Firm*—Allegretti, Newitt, Witcoff & McAndrews

[57] ABSTRACT

A method for producing tobacco in calendered foil form from a mixture of pre-comminuted tobacco, a powdered cellulose derivative binder, water and an organic solvent in which the solvent is mixed with the dry mixture of binder and tobacco to swell and moisten the binder, then the water is added and mixing continued to produce a homogeneous granular mass which is calendered into a smooth continuous foil. The solvent contains a liquid which boils below 100°C. (a lower alcohol, ketone, haloalkane, ester or ether) and a liquid which boils above 100°C. (a polyhydric alcohol or potassium lactate solution). The homogeneous granular mass can be rolled into a foil on a single three-roll mill or calender.

5 Claims, 1 Drawing Figure

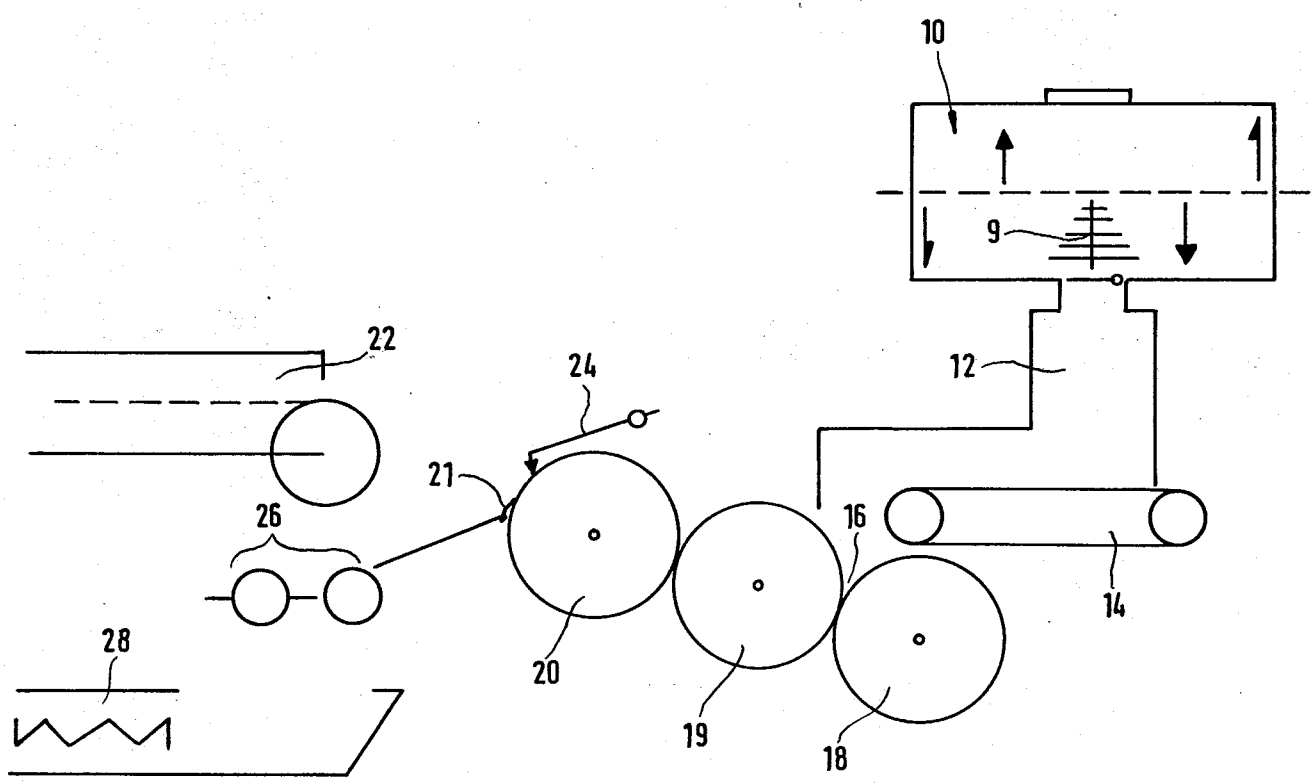
10
9
12
14
16
18
19
20
21
22
24
26
28

METHOD FOR MANUFACTURING TOBACCO FOIL

THE PRIOR ART

It is known to produce tobacco foils by rolling the foil web from a moist friable tobacco mass on three-roll mills, suitably connected in series. The tobacco mass consists mainly of comminuted tobacco, possibly a binder, and water. Monohydric or polyhydric alcohols can be added to the later (German application No. 1,532,042).

The alcohols clearly must be used in small quantities because the necessarily long processing travel does not permit larger quantities of readily volatile fractions. Apparatus required for the rolling operation consists of a pair of fluted entry rolls, a long pre-rolling train, consisting of four three-roll mills and a multiple roll assembly for the final treatment, that is to say, an extraordinarily expensive assembly of technical equipment. In addition, appliances are necessary to prevent an alignment of the tobacco fibers longitudinally by breaking and displacing the foil during transport between the three-roll mills.

On the other hand, a process of the applicants (German application No. 2,055,672) operates with nonaqueous organic solvents, mainly methanol/methylene chloride in the ratio by weight of 2:8, for the solvent-soluble methyl cellulose and other cellulose derivatives used as binder for forming a tobacco foil. These anhydrous constituents can be quickly prepared in a conventional mixer without any difficulties to form a homogeneous mass which can be rolled out.

It is possible in this way to produce a satisfactory tobacco foil with only one three-roll mill, which foil is successfully employed as rolled leaf, wrapper and filler in the manufacture of cigars and as a cover and also as a filler in the production of cigarettes. The ready volatility of the solvents is so great that they can be removed from the foil and recovered at moderately-elevated temperatures.

THE INVENTION

It is the object of the invention, in connection with the production of tobacco foils, to incorporate into the tobacco mass, with the aid of solvents, the quantity of water necessary for the further processing of the tobacco foil at the commencement of the manufacturing process, thereby saving costly solvents, and in addition making possible a simple economic manufacturing operation.

It was found that initially a friable, moist mass was formed during the thorough fulling of the water-moistened tobacco mass in the conventional pre-mixing kneader but that this moist mass is unable to be processed on a three-roll mill to form a satisfactory foil, because the mass is not homogeneous. However, if the kneader is allowed to continue operating, then the mass is transformed into a viscous mastic, the interior of which is deprived of further homogenization, thorough moistening and swelling. Large agglomerates are formed, which cannot pass the entry rolls of the three-roll mill.

Of fundamental importance for overcoming this difficulty is the use of a special mixing apparatus. The findings as previously described show that the preparation of a moist friable mass by means of a pre-mixing kneader does not provide the necessary homogeneity of the mass necessary to avoid the enormous expense of the many rolling mills connected in series and produce the additional advantages hereinafter described.

The mixing apparatus to be used must be a batch mixer which operates by the centrifuging and whirling method and in addition has a separately-driven beater knife head rotating at high speed and built into the mixing drum, the head causing the comminution of the agglomerates during the mixing process. The cooperation of the centrifuging and kneading blades with the knife or cutter head of the mixer, and the presence of the mixture of solvent and water, does in fact make possible the necessary intensive and thorough mixing of the substances initially in powder form to convert them into the granulated material capable of being processed on a three-roll mill. This mixer can also be adjusted to the best possible temperature for the mixing and swelling operation. Preferably, the internal temperature of the mixer, together with contents, is to remain just below the boiling point of the most readily volatile solvent component. The mixer also is tightly sealed so as to prevent the escape of vaporized solvent.

The following operations take place in the mixer:

In the first place, desired proportions of tobacco and methyl cellulose or other suitable cellulose derivatives (binder), and possibly also cellulose fibers, are initially mixed in the dry state. Then the solvents are added to uniformly moisten and slightly swell the cellulose derivative in the mixing time provided. Thereafter, water is added. During the further mixing process, a rapid and uniform swelling or steeping of the binder and an intensive and thorough mixing of the contents occurs. The mass becomes heated by frictional mixing. Consequently, a large part of the most readily volatile solvent vaporizes and condenses again on the cooled walls and wets the small agglomerates broken up by the cutter head. Since the most readily volatile solvents, e.g. methylene chloride, does not in itself dissolve the cellulose derivative, it assists as a separation agent in the formation of a fine granulated substance. Granules which are of the size of grains of sand but are per se plastic are formed, and these granules readily pass the smooth entry rolls of the three-roll mill, independently of the angle of the roll gap. A continuous, defect-free foil is formed without any difficulties during the fulling process in the rolling mill. It follows that the intensive homogenization process of water-containing tobacco masses can be completed at low cost using a suitable mixer and suitable solvents.

The parallel alignment of the tobacco fibers, or other added fibers, and the resultant reduction in transverse strength is avoided by the intensive but nevertheless gentle kneading and comminution of the tobacco mass. Only one three-roll mill is necessary after the complete homogenization. It is well known that when using multi-roll mill systems, fibers are positively and uniformly aligned parallel to the direction of travel, so that it is necessary to provide additional devices for turning over the material between the rolling mills.

For the smooth operation of the three-roll mill, the uninterrupted acceptance of the optimally homogenized mass by the pair of entry rolls and the discharge of a coherent and sufficiently solid foil, the composition of the liquid system being used is of particular importance, apart from the use of a special mixing process.

We have discovered an appropriate combination of liquids which, for the first time, makes possible not only the formation of fine, homogeneous granulated substances in the mixer, as previously described, but also the satisfactory processing of the tobacco composition on the rolling mill.

The liquid system consists of at least three components, which are clearly distinguished from one another with respect to their volatility:

Component A:

At least one solvent boiling below 100°C. and from the following classes of compounds:

| | Examples |
|---|---|
| Alcohols: | Methanol<br>Ethanol<br>Isopropanol |
| Ketones: | Acetone |
| Haloalkanes: | Methylene Chloride<br>Chloroform |
| Esters: | Ethyl Acetate |
| Ethers: | Diethyl Ether |

Compoung B:

Water

Component C:

At least one liquid boiling above 100°C., such as

| | Examples |
|---|---|
| Dihydric alcohols: | Diethylene Glycol<br>1,2-propylene glycol<br>Triethylene Glycol<br>1,3-butylene glycol |
| Polyhydric alcohols: | Sorbitol |
| Potassium lactate solution | |

By the addition of water (Component B), which must always be present, the total quantity of liquid necessary for the production of the millable mass is considerably reduced. Not only the proportion of organic solvents can be reduced by the added quantity of water, but in addition the total liquid quantity can be lessened.

The swelling of the binders during the mixing process is considerably intensified by the coaction between organic solvents (Component A) and water.

The water can be added in such a quantity that the finished tobacco foil has the required moisture content without any aftertreatment. Furthermore, the workability of the initial mass on the rolling mill is controlled with the aid of the water addition by influencing the swelling and adhesive power of the mass.

Substantially all of the quantity of the Components B and C added to the mass remains in the foil removed from the rolling mill, while the major part of the readily voltatile Component A leaves the foil, particularly if the delivery roll of the three-roll mill is heated. As a readily volatile technical auxiliary substance, Component A has the functions of producing:

a. a thorough mixing of the mass,
b. a sufficiently uniform swelling of the cellulose derivative particles,
c. a readily millable mass, and
d. a sufficient solidification of the foil on the delivery roll.

The high-boiling Component C has the function of a separation agent as well as the property as known per se of a moisture-maintaining agent. By the vaporizaton of the readily volatile Component A, an enrichment and also a partial deposition of the Component C occurs, particularly on the heatable delivery roll. The film as thus formed on the delivery roll from the Component C makes possible a smooth lifting of the foil from the roll.

The frictional heat occurring on the pair of entry rolls can be dissipated. Without cooling, the mass frequently adheres too tightly to the roll surface. A satisfactory transfer to the following roll is then impossible.

The temperature of the delivery roll must be adjusted so that it corresponds at least to the boiling temperature of the most readily volatile Component A.

By adhering to the parameters of the invention as described, it is possible to bring the speed of production up to about 300 m/min. without any deleterious effect on the quality of the foils.

The formed tobacco foil is taken up by an endless conveyor belt, which consists for example of wire links or textiles, and is preferably guided through a drying duct, at the end of which the tobacco foil is processed in known manner into the form of bobbins or sheets. However, the foil can also be cut with suitable devices into sheets on the delivery roll and these sheets, when stripped off, are supplied to the final drying stage.

The readily volatile solvents being used can be recovered in the usual way.

As an additional compound under the Components C, it is possible to use a potassium lactate solution, which is known to have a moisture-holding action.

If cellulose fibers, agents for improving burning, or cross-linking agents are to be incorporated into the tobacco foil, the addition is effected, depending on their solubility or miscibility, during the mixing process.

SPECIFIC EXAMPLE

The invention will now be described by reference to an example for the production of a foil for calendering. The following recipe produces a good quality foil:

| | | |
|---|---|---|
| Pre-comminuted tobacco | 20 | parts by weight |
| Cellulose derivative (highly methylated methyl cellulose) | 4 | " |
| Methylene chloride | 9 | " |
| Methanol | 9 | " |
| Triethylene glycol | 2 | " |
| Water | 3.5 | " |

In the example referred to above, highly methylated methyl cellulose is used as binder. Other cellulose derivatives may be used in accordance with the solvent mixture used. For example, acetyl cellulose, ethyl cellulose, hydroxypropyl methyl cellulose and hydroxyethyl methyl cellulose or other cellulose derivatives can be used.

The tobacco can be natural, pre-comminuted tobacco, tobacco dust, such as is formed in the industry for processing tobacco, leaf tobacco and rib tobacco particles and also tobacco extracted beforehand with water or organic solvents.

Suitable fiber materials which may be added to the foil for improving the mechanical strength, include, for example, cellulose fibers, staple rayon fibers, asbestos fibers or the like.

The size of the tobacco particles should advantageously be in the range from 0.05 mm to 10 mm. These figures refer to the largest length dimension of a tobacco particle. However, where it is a question of a stem or stalk particle, which has a greater thickness than a leaf particle, the largest length dimension is advantageously around 100 $\mu$. The particle size of the cellulose binder should be as fine as possible, since the first operating step, namely, the dry pre-mixing of tobacco particles and cellulose derivative particles, is essentially a powdering operation. The temperature of the mixing of the organic solvent mixture with the solid particles, namely, the particles of tobacco and binder, is advantageously completed in a range around 30°C. when using, for example, methylene chloride, which has a boiling point of 39°C. the boiling point of the lowest boiling solvent is higher, the processing temperature range is also raised to just below the boiling point of this solvent.

A mixing time of 2 or 2 ½ minutes is suitable for the dry mixture of tobacco and cellulose derivative, and for the organic solvent mixture of which the mixing time is related to the constituent having the lowest boiling point, or to the mixing time after the addition of water. These times can be increased or decreased according to the solvent mixtures used and the times required for swelling the cellulose derivatives and/or in dependence on the properties of the initial tobacco material. What is important is the production of a homogeneous, moist, but still flowable granulated material.

BRIEF DESCRIPTION OF THE DRAWING

The drawing represents a schematic of applicants' apparatus.

THE APPARATUS

The accompanying drawing is a flow sheet for the process of the invention showing diagrammatically the various elements.

Initially, tobacco and the methyl cellulose used as binder is mixed dry for 2 minutes in the mixer 10. A mixer of this type having an additional cutter head, the axis of which is radially of the axis of the mixer drum, as described above, is, for example, manufactured by the firm Gerb. Lodige, of Paderborn, West Germany. Thereafter, a mixture of methylene chloride, methanol and triethylene glycol in the proportions by weight as indicated is introduced into the mixer and mixing continues for 5 minutes with exclusion of air. The organic solvents, namely, methylene chloride, methanol and triethylene glycol, are advantageously mixed with one anoter in the indicated quantities before being added to the mixer.

After the time period of five minutes has elapsed, water is introduced into the mixer, namely, 3.5 parts by weight, and mixing takes place for another two minutes. The result of the mixing operation is a granulated material which is discharged, with the cutter head 9 rotating, into a silo 12, which has as its bottom a conveyor belt 14, which transports the granulated material into the gap 16 of a pair of entry rolls 18, 19. The discharging roll 20 transfers the finished foil web, by way of the stripper 21, into a drying device 22, in which the last residues of the volatile organic liquids are removed.

The delivery roll 20 can however also be provided with a cutter device 24, by which the foil already on the delivery roll is cut into a plurality of strips, which are then transported by the stripper 21 to a transverse cutting device 26, in which the strips are cut transvesely into so-called sheets. These sheets drop into a drying apparatus 28, in which they are freed from the volatile solvents. As already mentioned, the mixing takes place in the mixer with exclusion of air, but also the transfer of the granulated material into the roll gap 16 takes place with exclusion of air, so that any possible vaporization of solvent from the grandulated material is prevented.

We claim:

1. A method of making a tobacco foil from tobacco particles, binder particles, a liquid organic solvent and water by mixing in a sealed mixer so as to prevent the escape of said solvent by vaporization, said liquid organic solvent being adapted to liquify said biner particles and having at least a first and second component, said first component having a first boiling point, comprising the steps of:

admixing said tobacco particles and said binder particles to form a particulate mixture;

adding said organic solvent to said particulate mixture in said sealted mixer to moisten and swell said binder, thereby providing a moistened mixture;

kneeding said moistened mixture;

adding said water to said moistened mixture;

continuing to kneed said moistened mixture and said water to produce a homogeneous granular mass;

maintaining the internal temperature of said sealed mixer together with the temperature of its contents near said first boiling point;

rolling said homogeneous granular mass into a sheet; and evaporating said organic solvent from said sheet to produce said tobacco foil.

2. A method as claimed in claim 1 further comprising the steps of:

causing said first component of said organic solvent to evaporate from said moistened mixture and said homogenous granular mass.

3. A method as claimed in claim 1 wherein said method utilizes a delivery roller to accomplish said rolling step, said method further comprising the steps of:

heating said delivery roller; and depositing said second component of said organic solvent on said delivery roller to facilitate removal of said sheet.

4. A method as claimed in claim 1 further comprising the step of adding fiber particles to said tobacco particles.

5. A method as claimed in claim 1 wherein at least one of said components of said liquid organic solvent is water miscible and a portion of said water miscible component is mixed with said water prior to addition to said particulate mixture.

* * * * *